US007413091B2

(12) United States Patent
Krull

(10) Patent No.: US 7,413,091 B2
(45) Date of Patent: Aug. 19, 2008

(54) ROLLING STORAGE RACK SYSTEM

(75) Inventor: Krystal Krull, Englewood, CO (US)

(73) Assignee: Big O Tires, Inc., Englewood, CO (US)

( * ) Notice: Subject to any disclaimer, the term of this patent is extended or adjusted under 35 U.S.C. 154(b) by 68 days.

(21) Appl. No.: 10/824,646

(22) Filed: Apr. 15, 2004

(65) Prior Publication Data

US 2005/0230337 A1 Oct. 20, 2005

(51) Int. Cl.
*A47F 5/00* (2006.01)

(52) U.S. Cl. ..... 211/162; 211/23; 312/132; 312/201

(58) Field of Classification Search ..... 211/162, 211/23, 24; 312/201, 131, 132
See application file for complete search history.

(56) References Cited

U.S. PATENT DOCUMENTS 1,807,075 A * 5/1931 Skar et al. ..... 104/121
2,812,069 A 11/1957 Trammell
2,915,195 A 12/1959 Crosby
2,928,550 A * 3/1960 Stobie ..... 211/46
3,557,966 A * 1/1971 Skubic ..... 211/24
3,567,039 A * 3/1971 Evans ..... 211/162
3,691,590 A * 9/1972 Drabert ..... 16/18 R
3,737,047 A 6/1973 Ruth
3,801,176 A * 4/1974 Higbee ..... 312/199
4,615,449 A * 10/1986 Naito et al. ..... 211/162
4,618,191 A * 10/1986 Peterman ..... 312/201
4,807,765 A * 2/1989 Brown et al. ..... 211/162
4,941,578 A * 7/1990 Devening ..... 211/186
4,991,725 A 2/1991 Welsch et al.
5,076,442 A * 12/1991 Hakeem ..... 211/34
5,597,217 A * 1/1997 Hoska et al. ..... 312/201
5,636,750 A * 6/1997 Heyl ..... 211/1.57
5,680,942 A 10/1997 McAllister
5,938,047 A * 8/1999 Ellis et al. ..... 211/1.57
6,241,106 B1 * 6/2001 Fujita et al. ..... 211/134
6,471,309 B1 10/2002 Turner
6,510,954 B2 * 1/2003 Reddig ..... 211/162
6,726,039 B2 * 4/2004 Boron ..... 211/162
7,143,474 B2 * 12/2006 Welsch et al. ..... 16/94 R

* cited by examiner

*Primary Examiner*—James Kramer
*Assistant Examiner*—Jared W. Newton
(74) *Attorney, Agent, or Firm*—Jacobson Holman PLLC

(57) ABSTRACT

Attached to an upper end or rear sidewall of each of a plurality of movable racks is a hollow tube mounted on a rectangular plate in two places on each rack. Passing through the hollow tubes of each of the plurality of movable racks is a solid rod having a diameter of one to two inches. The solid rod is anchored at opposite ends on two stationary or fixed racks to facilitate sliding of the plurality of racks across a floor. No special equipment is required to maximize floor space for storage of tires.

12 Claims, 11 Drawing Sheets

ROLLING STORAGE RACK SYSTEM

FIELD OF THE INVENTION

The present invention includes a system for moving vertical racks of material, preferably automobile tires, while minimizing floor space to facilitate shifting of a plurality of racks so as to gain access to the tires by walking into a space created between two adjacent racks.

BACKGROUND OF THE INVENTION

Movable rack assemblies are known for storing quantities of materials such as work folders. Typically, each rack assembly is guided by a plurality of rails or guide tracks located in or on the floor. A manually rotated drive assembly is sometimes used to move a plurality of racks relative to stationary or fixed racks, which are typically located at opposite ends of the movable racks. The track or guide system located in or on the floor is usually of a design shaped complementary to the wheels, rollers or other conveyance mechanisms used to move the various racks.

It is also possible to use an overhead rail system, typically including a horizontally oriented roller restrained within the side walls of a guide rail system. On the occasion where a vertically oriented roller is used, it is typically used in conjunction with horizontally oriented rollers.

Alternatively, in one known system, when using only vertically oriented wheels, a guide support rail having a precisely adjusted height is used. The rail is positioned so that the vertically extending wheels engage and are supported from underneath by a vertically lower portion of the rail.

SUMMARY OF THE INVENTION

It is an object of the present invention to provide a relatively simple arrangement of lower and upper guide wheels rollable on a plain concrete or other type floor to facilitate shifting of a plurality of racks between opposed stationary or fixed racks. The system may be easily installed in an open floor space since the system is self-contained and only requires the presence of floor space.

This object is accomplished by the use of a plurality of racks having a vertically oriented wheel at each of four corners of the base of each rack. Similarly located at the four corners of the upper end of the rack are located four wheels movable along two spaced apart U-shaped guide rails. The guide rails extend between two stationary or fixed racks along a path of intended travel of a plurality of movable racks.

To assist in guiding the movement of the overhead wheels within the U-shaped guide tracks is a U-shaped guide bracket having a cross piece interconnecting two arms. The bracket extends at its cross piece below the wheel to a point in front of and behind each wheel. Each of the bracket's opposing arms extends up into the guide track in front of and behind each wheel. The tip of each arm of the guide bracket is recessed below the crosspiece of the U-shaped guide track but within the confines of the arms of the U-shaped guide track so as to not only guide the movable storage rack along the guide track but to prevent access to the wheels and thereby prevent harm to the operator if the operator were so inclined to attempt to touch the overhead guide wheels.

The guide brackets also serve an anti-tipping function by extending into a space defined between the arms of the U-shaped guide track. Tipping is prevented by engagement of the guide bracket with the guide track when an excess force is applied to the rack.

In a particularly preferred embodiment, where excess floor space is available, the distance between the arms of the U-shaped guide bracket of adjacent racks project to an extent to engage a corresponding U-shaped guide bracket of an adjacent movable rack. The adjacent guide brackets engage and space the two adjacent racks a predetermined distance from each other. When used for storage of tires, the separation distance between the adjacent movable racks may preferably be a gap equal to 1½ times the diameter of a typical tire, preferably 1⅓ times the diameter of a typical tire. This facilitates a minimum spacing between adjacent racks where floor space is not a primary concern and movement of the racks is still desired.

In the embodiment where minimal floor space is available, the separation distance of the U-shape guide brackets between adjacent racks may be controlled such that adjacent movable racks may approach each other only to an extent to avoid contact of the tires located in each adjacent rack. This prevents jostling or movement of the tires in each rack. Therefore, the separation distance between adjacent racks is adjustable depending upon space considerations and a desire to avoid contact between the tires of adjacent racks.

Another advantageous feature of the present invention includes the positioning of a shock absorber between the mounting plates of the upper guide wheel and the movable rack. Typically, the shock absorber will take the form of a foam or a rubber layer, preferably one quarter inch in height. This resilient barrier absorbs the shocks imparted to the movable rack to avoid placing undo stress upon the upper guide wheels.

In an alternate embodiment of the present invention, instead of upper guide wheels riding within a U-shaped guide track, attached to an upper end or rear sidewall of each of the plurality of movable racks is a hollow tube mounted on a rectangular plate in two places on each rack. Passing through the hollow tubes of each of the plurality of movable racks is a solid rod having a diameter of one to two inches. The solid rod is anchored at opposite ends on two stationary or fixed racks.

A separation gap between the solid rod and the hollow tubes is preferably 1/16 to ⅛ inch. This separation distance contains a low friction lubricant or material such as a silicone lining or a low friction material available under the trade name TEFLON to facilitate sliding of the rod within the sleeves.

It is particularly advantageous to locate the rod and sleeve assembly along a rear side of the rack to reduce an overall height requirement for the racks. This facilitates usage of the present system in a building having limited vertical height.

Another advantageous feature of the present invention is the use of wheel foot guards or boots surrounding the extremity of the lower guide wheels. These enclosures of the lower guide wheels prevent accidental engagement of the wheels with the foot of an operator. An operator may thereby grab a movable rack and roll the rack in a particular direction, as controlled by the overhead guide brackets or solid rod and hollow sleeve assemblies so to gain access to an interior space between two adjacent movable racks. A particular sized or type of tire stored in the racks, may then be accessed.

Even with a vast number of storage racks, only sufficient space is required to gain access between any two successive adjacent racks. The position of the racks is variable so as to accommodate the necessary access space where required. By supporting the racks on wheels which are rollable along any flat surface, the need for guide tracks in or on the floor or some other special arrangement is no longer necessary.

Accordingly, one of the objects of the present invention is to provide an easily adaptable system of movable racks which can be incorporated into almost any existing space.

It is another object of the present invention to provide a rolling storage rack system having fixed racks at opposite ends and plurality of movable racks in between the fixed racks with a guide system for moving the movable racks being anchored on the two opposed fixed racks.

It is another object of the present invention to provide a rolling storage rack system having a guide rail extending between two fixed racks and a plurality of movable racks having wheels on a bottom surface and wheels on a top surface with the wheels on the top surface engaging the guide rails for sliding movement of the movable racks and the upper wheels having guide brackets located in a space defined by the guide rails for controlling a positioning of two adjacent movable racks and for preventing tipping of the movable racks.

It is still yet another object of the present invention to control movement of a rolling storage rack system by a guide rod extending between two fixed racks and a plurality of movable racks having guide pipes encircling the guide rod controlling the sliding movement of the movable racks and having a lubricating layer located between the guide rod and guide sleeves.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
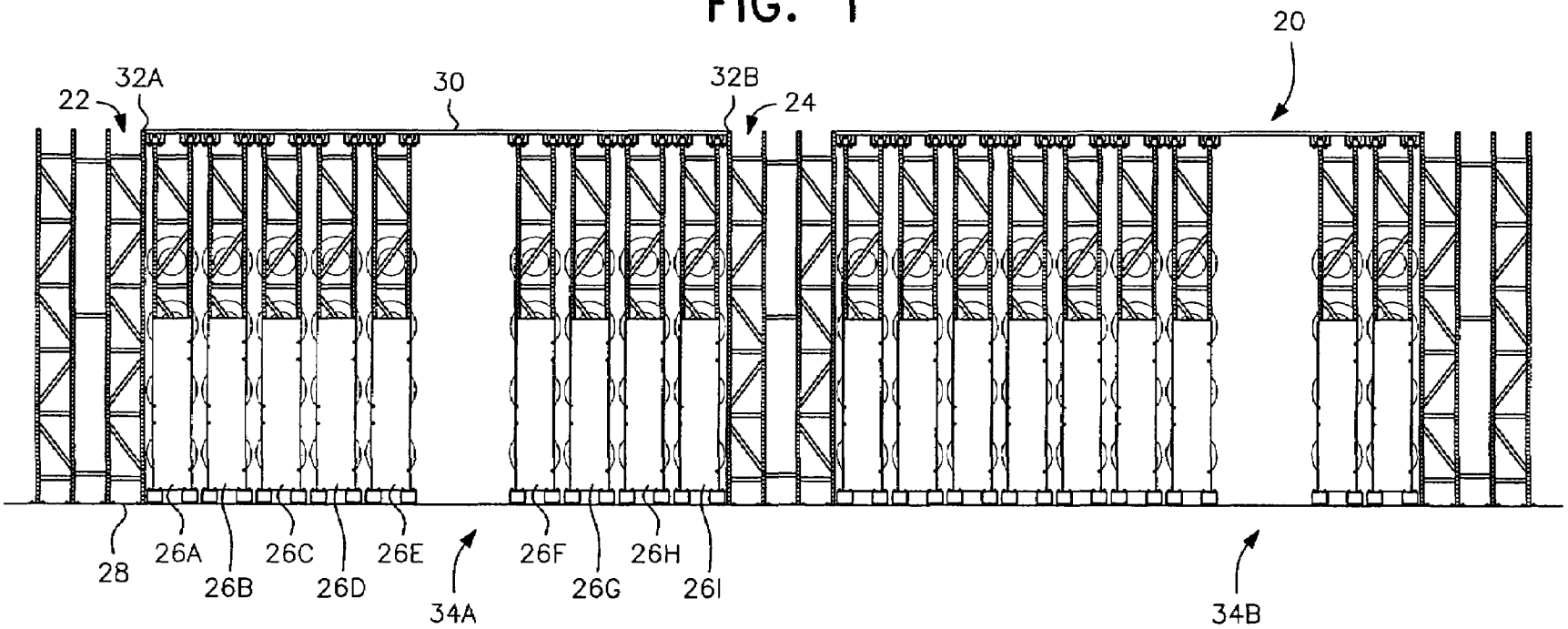
FIG. 1 is a side view of a plurality of movable racks incorporating the features of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 7, in particular, a rolling storage rack system embodying the teachings of the subject invention is generally designated at 20. With reference to its orientation in FIG. 1, the rolling storage rack system includes two stationary racks 22, 24. Between the two stationary racks are a plurality of movable racks 26A, 26B, . . . , 26I. Each of the movable racks are movable along the floor 28, typically in an enclosed area. The movable racks are movable along, in this embodiment, a pair of guide rails 30 extending between the two stationary racks 22, 24. Two opposite ends 32A, 32B of the guide rails are secured to the stationary racks 22, 24.

Figure 2:
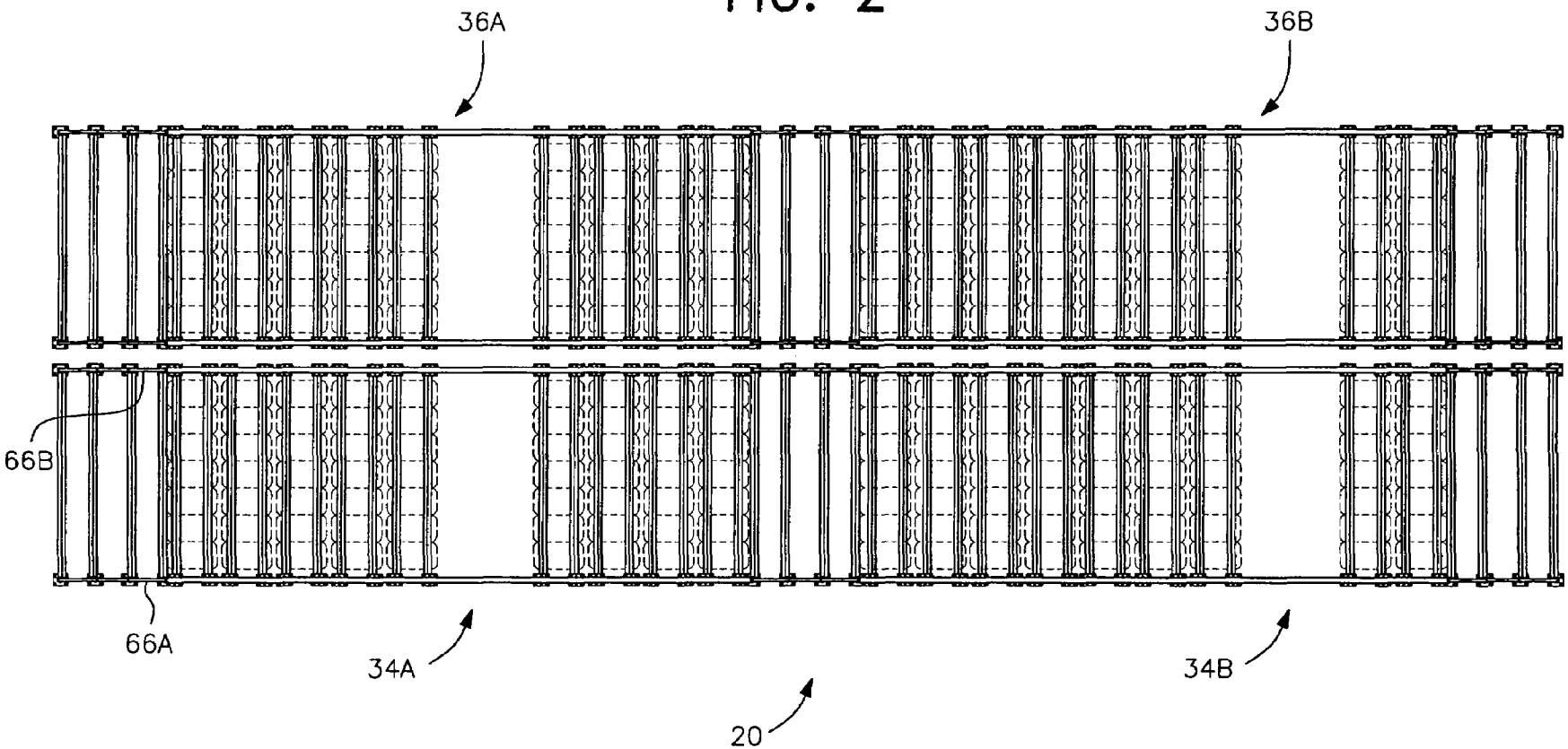
FIG. 2 is an overhead view of the plurality of movable racks shown in FIG. 1.

In the example shown in FIG. 1, two sets of movable racks 34A and 34B are shown extending in a single row. It is envisioned, as shown in FIG. 2, that a second set of movable racks 36A, 36B are located in another row located to one side of the plurality of racks 34A, 34B. The number of racks and the amount of rows of racks is dependent upon the available floor space. It is considered within the scope of the present invention to vary both number of racks in each row and the number of rows according to available floor space.

In the example shown, each of the racks, including both the movable racks as well as the stationary racks, could be used for the storage of tires 38. In FIG. 1, four levels of tires are shown stored in each rack. It is understood that a fifth level of tires could be stored in each rack as well as storage of the tires in the stationary racks. The number of tires would depend upon the amount of available inventory being stored.

Figure 3:
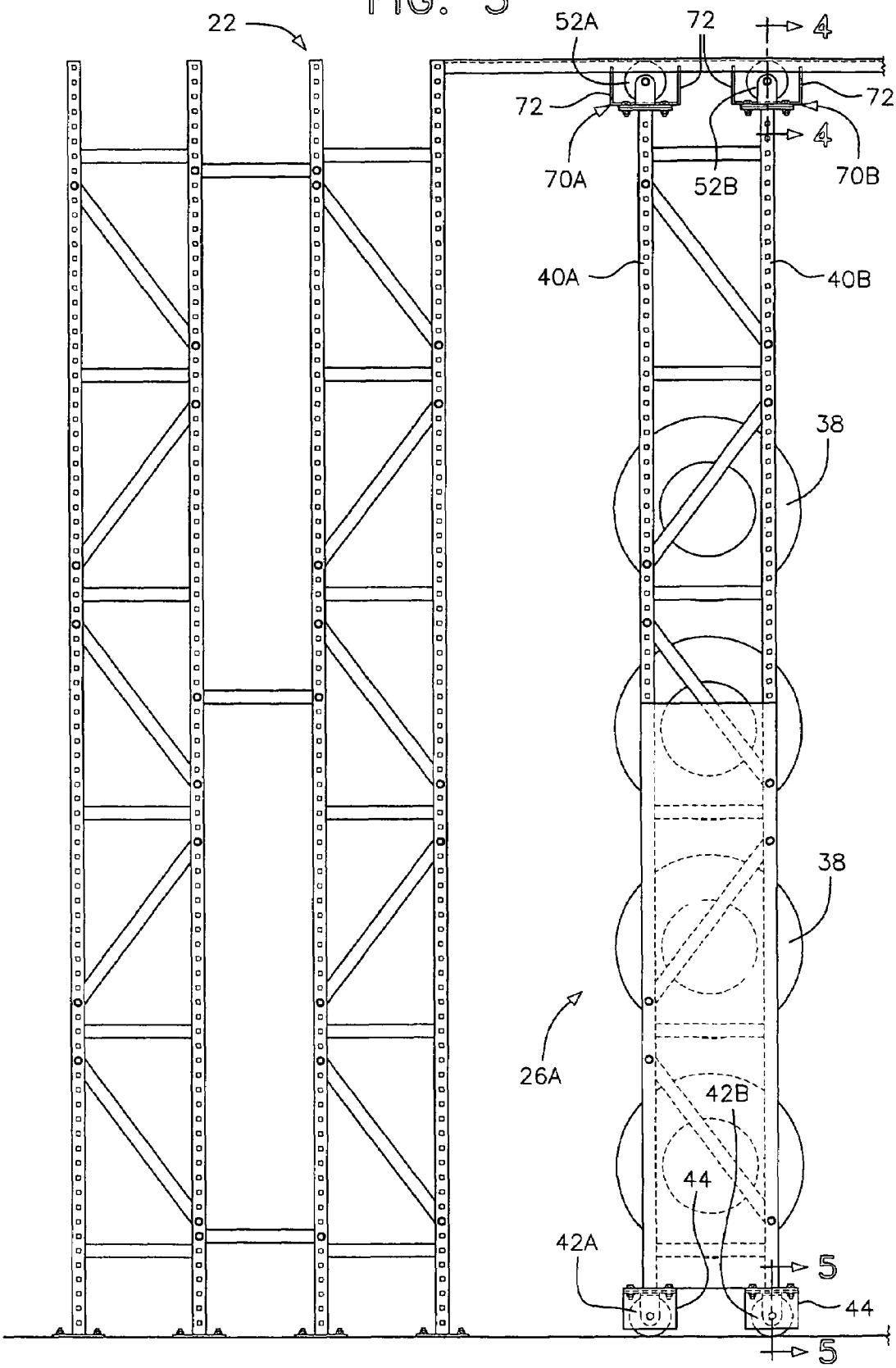
FIG. 3 is a detailed view of one embodiment of the present invention used to guide a plurality of movable racks.
Figure 7:
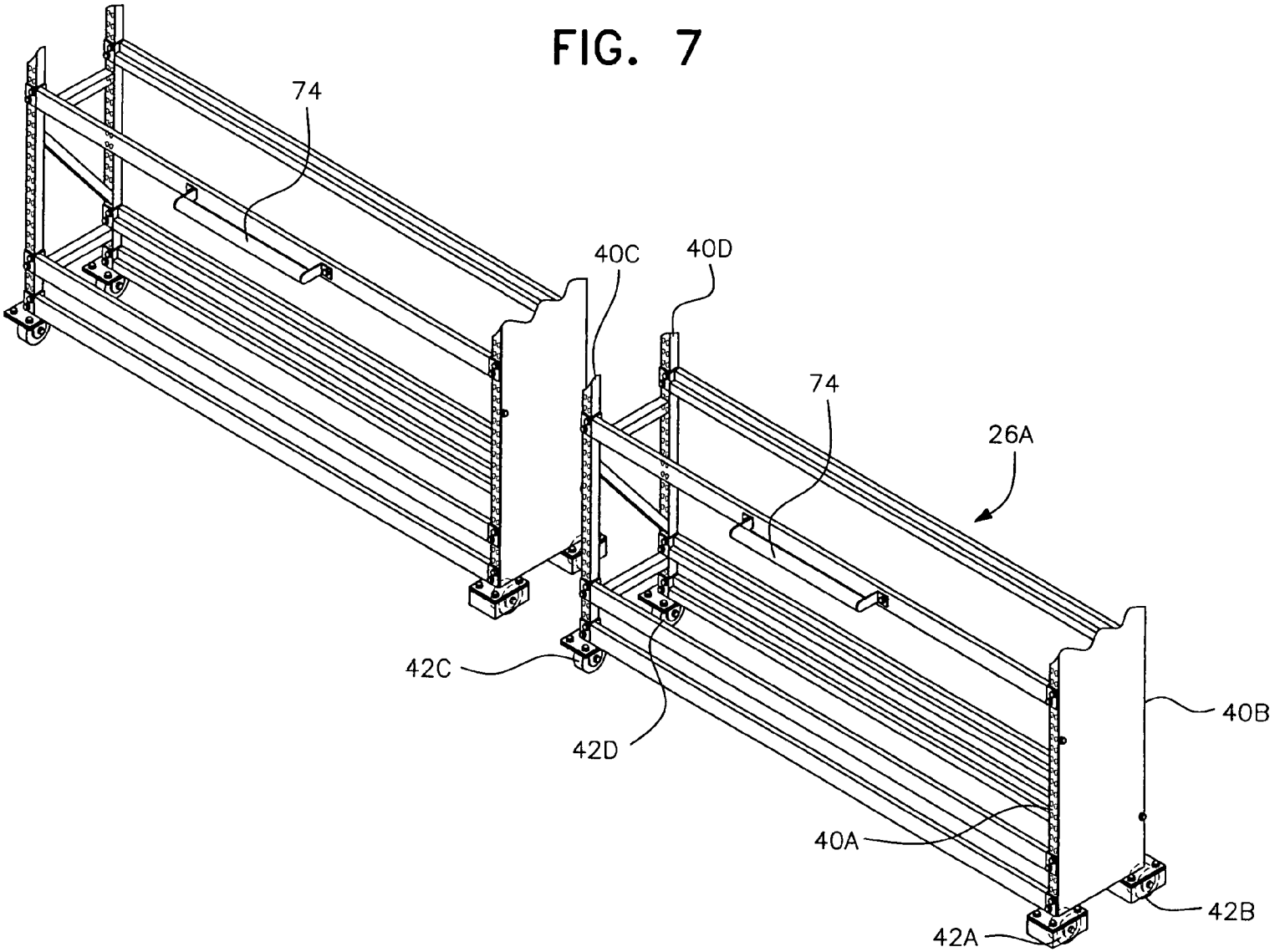
FIG. 7 is a perspective view showing a plurality of rows of racks which multiply the amount of storage space available based upon the number of rows of racks.

As shown in greater detail in FIG. 3, movable rack 26A is formed of a plurality of vertically rising struts 40A, 40B with additional vertically rising struts 40C, 40D shown in FIG. 7, for example. At the base of each of the vertically rising struts is located a vertically oriented lower wheel 42A, 42B, 42C, 42D. When the term "vertically oriented" is used it is meant to imply that a plane extending parallel to the diameter of the wheel extends in a vertical direction.

Figure 5:
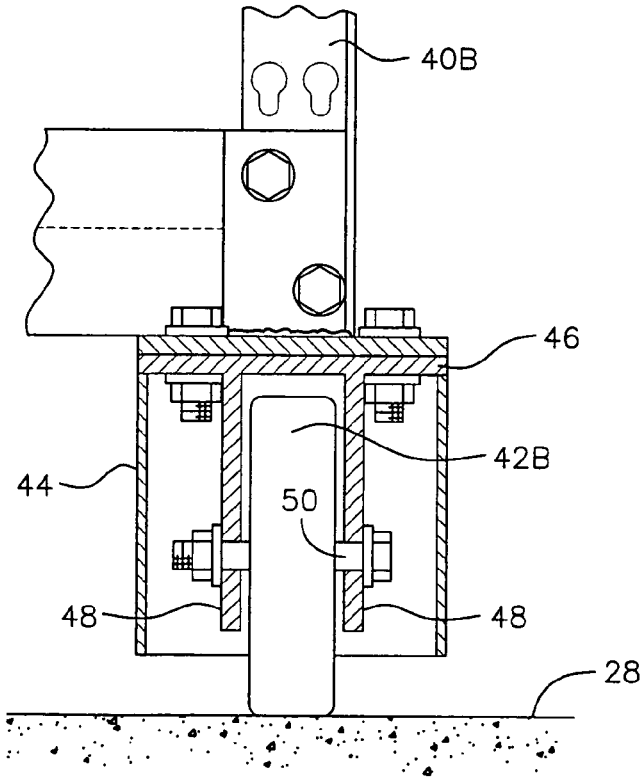
FIG. 5 is a sectional view taken along line 5-5 of FIG. 3.
Figure 6:
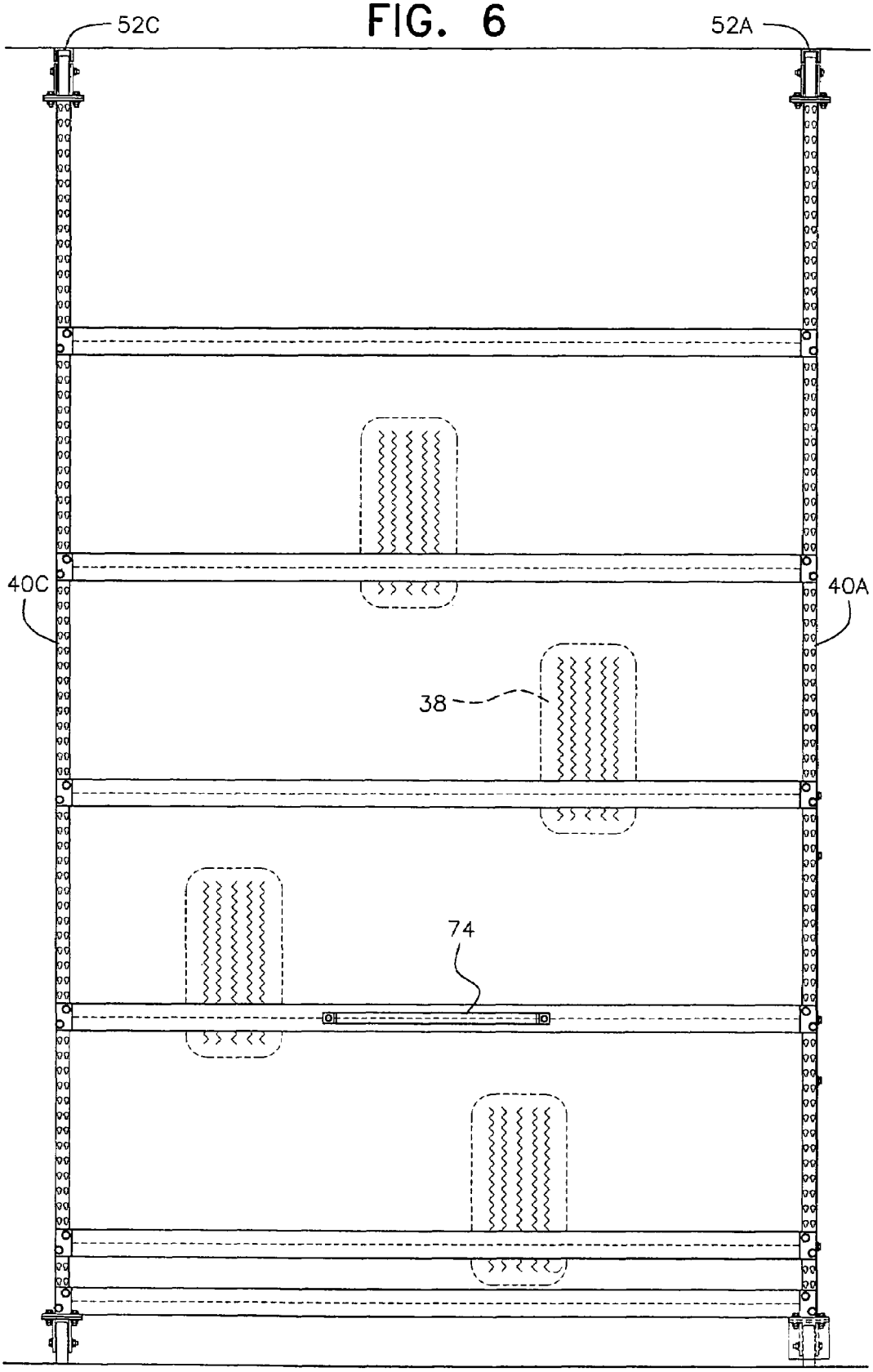
FIG. 6 is an end view of a rack incorporating the features of the present invention.

Surrounding wheels 42A, 42B, as shown in FIGS. 3 and 5 through 7, is a rectangular shaped enclosure or boot 44 as shown in greater detail in FIG. 5. The enclosure extends at its uppermost end from a plate 46 having downwardly extending ears 48 for supporting an axle 50 of the wheel 42B. The lower end of the boot 44 approaches the ground 28 but stops short of the ground to provide limited clearance of the boot 44 from the ground. The boot 44 protects the foot of an operator from encountering the wheel and being injured by the wheel. It is envisioned that a boot may be used with all of the wheels rolling on the ground, with only some of the wheels in the drawings being shown including the boot for illustrative purposes.

At the opposite end of the vertically rising struts is located another set of upper wheels 52A, 52B, 52C and 52D. The upper wheels are supported on a plate 54 having support ears 56 for wheel axle 58. Plate 54 is secured to a plate 60 located on top of the strut 40B by a plurality of bolts 62. Interposed between the plates 54 and 60 is a shock absorber layer 64 to lessen the force imposed on the rack 26A and potentially transmitted to the upper wheel 52B.

Figure 4:
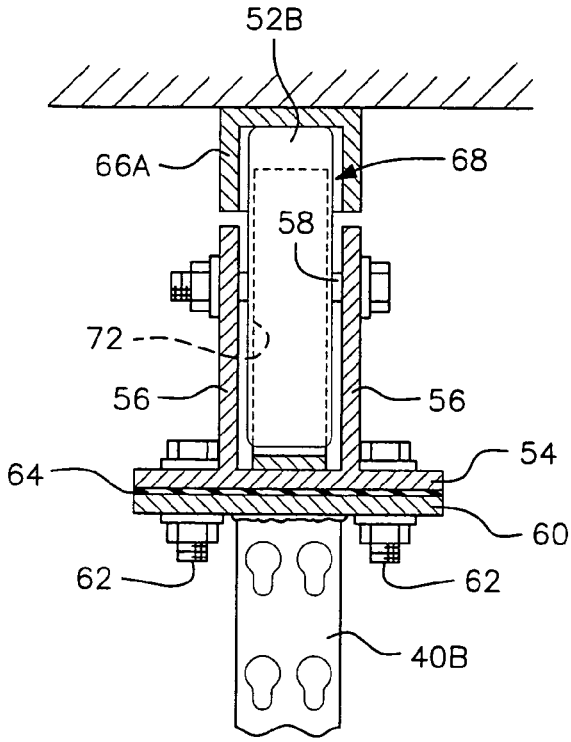
FIG. 4 is a sectional view taken along line 4-4 of FIG. 3.

Upper wheel 52B as well as the other upper wheels 52A, 52C, 52D are arranged to contact and travel within U-shaped guide rails 66A, 66B as shown in FIG. 2. With reference to FIG. 4, U-shaped guide rail 66A defines a space 68 within which the wheel 52B rotates.

To help guide the movement of the upper wheels 52A through 52B, prevent tipping of the movable racks 26A through 26I and to prevent access to the upper wheels 52A through 52D, U-shaped guide brackets 70A through 70D are provided for each of the upper wheels 52A through 52D. Each of the U-shaped guide brackets includes a cross piece located below the upper wheels 52A through 52D and two arms 72 which extend ahead of and behind each of the upper wheels 52A through 52D.

As shown in FIG. 4, the rear arm 72 is shown in dotted lines extending into the space 68 defined by the U-shaped guide rail 66A, as is also shown in FIG. 3. The arms 72 will prevent tipping of the movable racks by contacting of the arms 72 against the guide rail in the event of application of excessive force to the movable rack.

As shown in FIG. 3, the amount of extension of the arm 72 of the U-shaped guide bracket away from the respective upper wheels 52A through 52D is only slight. The forward extension of the arm 72 from the movable rack 26A is, in the embodiment shown in FIG. 3, sufficient to prevent contact of tires in an adjacent movable rack, for example, rack 26B, from contacting the tires in rack 26A. The contacting of the tires is avoided by the respective engagement of the arms 72 of the adjacent movable racks.

For movement of each movable rack, each rack may be grabbed by the hands of an operator along the vertically extending struts 40A, 40B and shifted to the left or to the right. Alternatively, a handle 74 may be placed on each rack for gripping and movement of the rack from a side of the rack inbetween adjacent racks.

Figure 8:
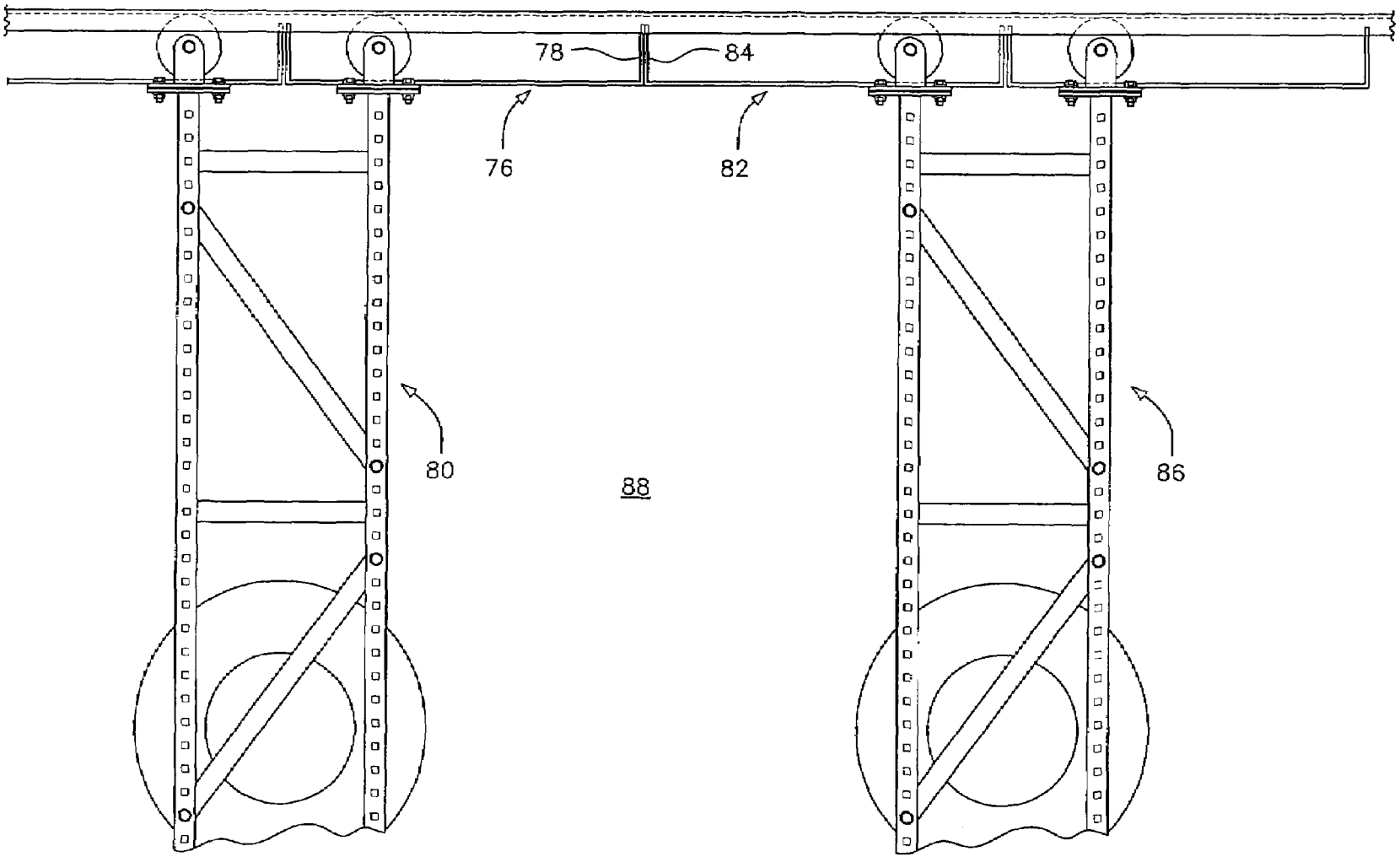
FIG. 8 is a detailed view of the overhead guide system of the present invention illustrating one embodiment of space controlling U-shaped guide brackets which are variable in dimension to control the separation space between every two successive adjacent racks.

In an alternate arrangement as shown in FIG. 8, where space considerations are not of primary importance or where a greater space between adjacent movable racks is desired, the U-shaped bracket 76 may have an arm 78 projecting ahead of a movable rack 80 so as to encounter a U-shaped guide bracket 82 having an arm 84 contacting the arm 78. As can be seen in this Figure, the space between the racks 80, 86 is substantially greater than the space shown for example between racks 26A and 26B of FIG. 1. In FIG. 8, space 88 is thereby created into which an operator may walk to retrieve a particular sized tire.

In FIGS. 9 through 13, an alternate arrangement is shown for moving a plurality of movable racks between two opposed stationary racks. In this embodiment, the lower wheel assemblies are the same. However, for guiding the movable racks, a solid guide rod or bar 100 extends between two opposed stationary racks 102, 104.

Figure 9:
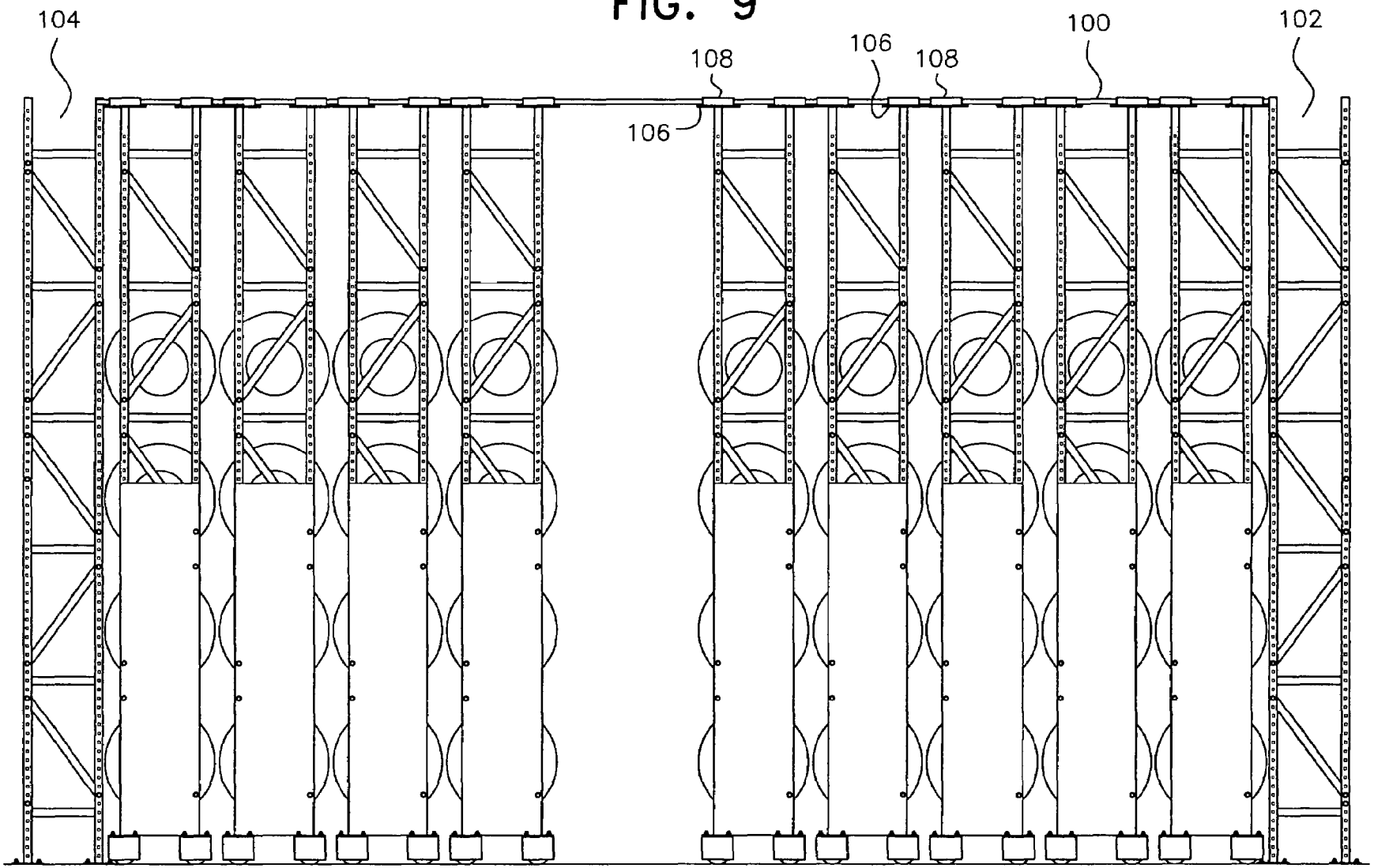
FIG. 9 is a side view of a plurality of movable racks incorporating an alternate control system for guiding the movement of the plurality of racks.
Figure 10:
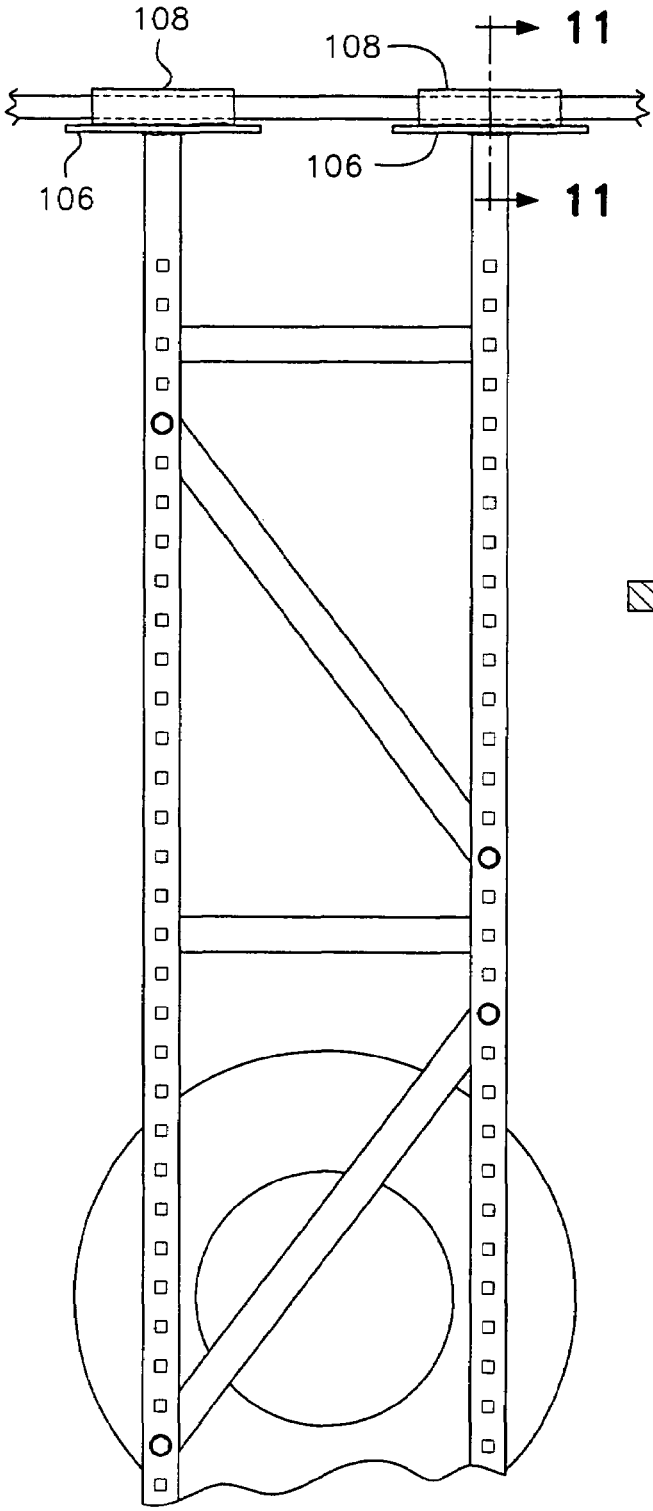
FIG. 10 is a detailed view illustrating the interdependence of a guide sleeve and slide bar or rod for controlling the movement of a movable rack.
Figure 12:
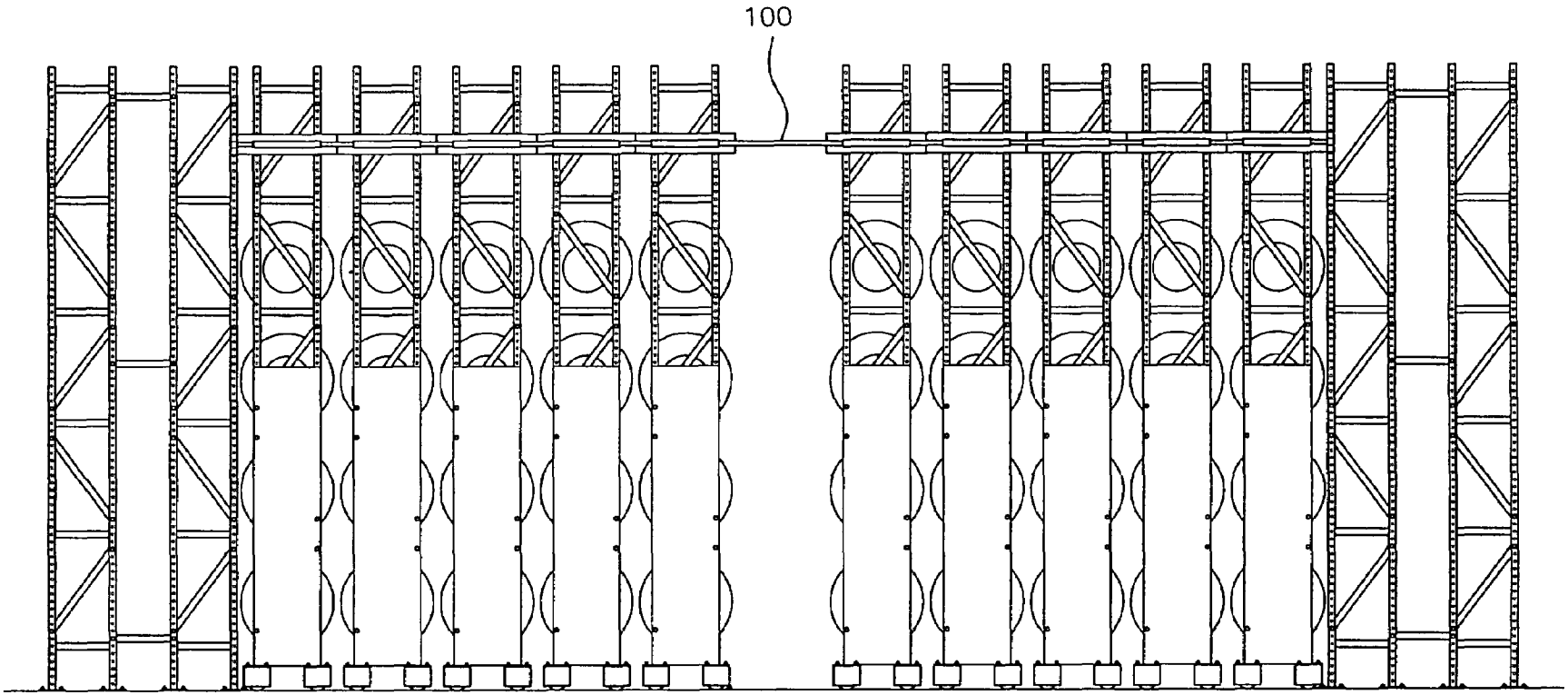
FIG. 12 illustrates a rear side view of a plurality of movable racks incorporating the guide sleeves and guide rod for controlled movement of the plurality of movable racks.
Figure 13:
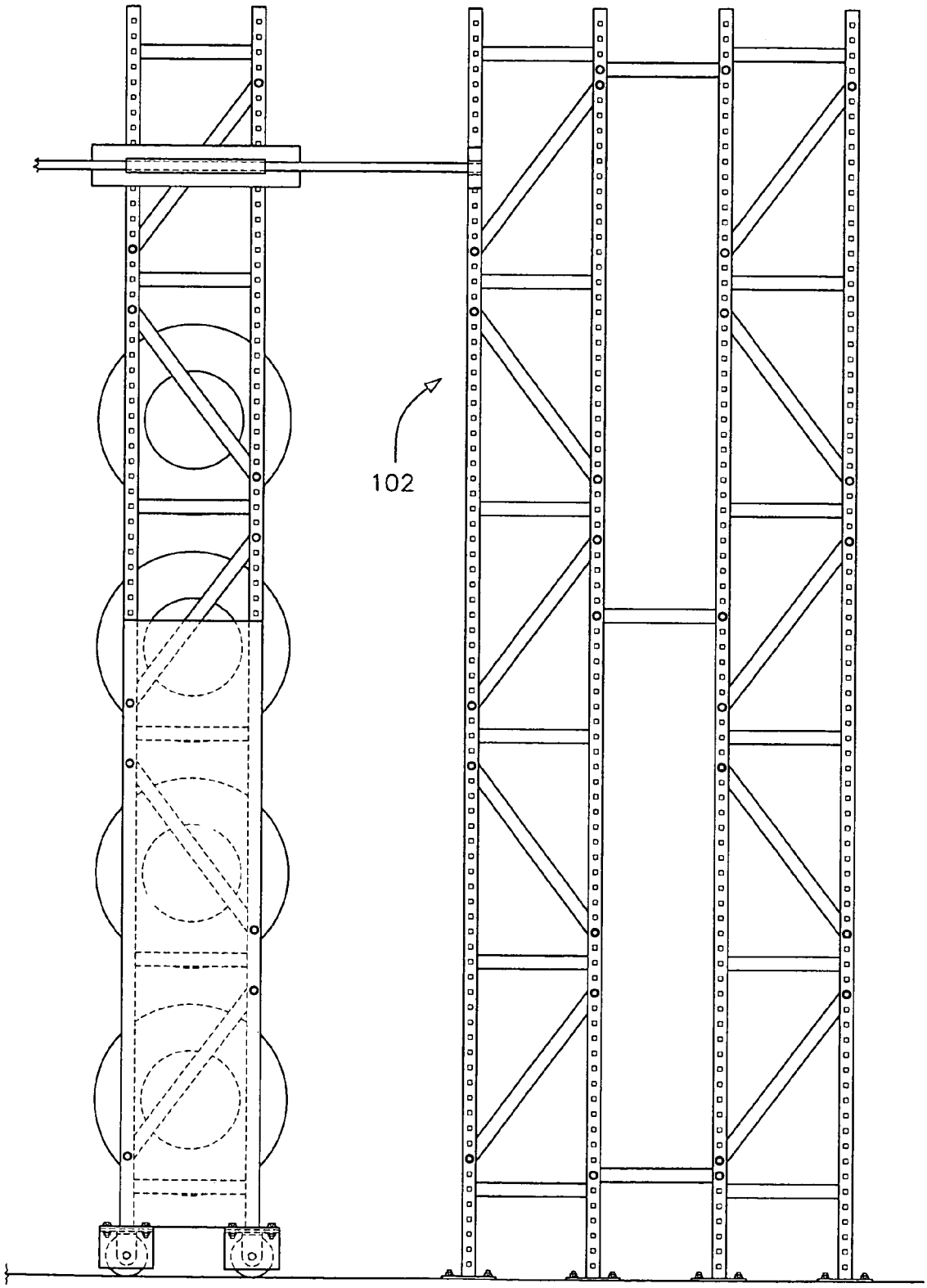
FIG. 13 is a detailed view of the cooperation of the guide rod and guide sleeves for controlled movement of the plurality of movable racks.

As shown in FIG. 9, the rod 100 extends across the upper end of each of the movable racks whereas in FIG. 12, the rod 100 extends along a side of the movable racks. In both FIGS. 9 and 12, a plurality of rectangular plates 102, 106 are located at the top struts. Secured to the plates 106 is a hollow tube or sleeve 108.

Figure 11:
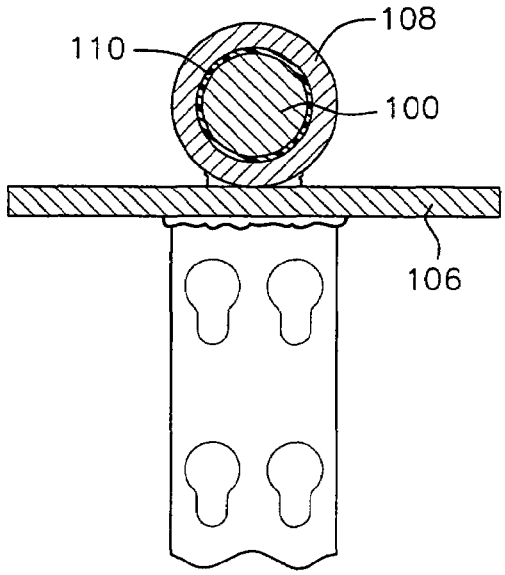
FIG. 11 is a sectional view taken along line 11-11 of FIG. 10.

As shown in cross section in FIG. 11, a gap between the rod 100 and tube 108 includes a lubricating layer 110 to help in sliding of the rod within the tube. This facilitates the guiding of the movable racks in a straight direction as guided by the rod 100.

A particular length of plates 102, 106 helps define a spacing between adjacent contacting racks. When a leading edge of plates 102, 106 on adjacent racks encounter each other, the racks are prevented from further movement towards each other. The length of the plate 102, 106 will be determined dependent upon space considerations and tire diameters to always maintain at least a two inch gap adjacent racks when filled with tires.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A tire rolling storage rack system comprising:

a plurality of tire storage racks having spaced horizontally extending crossbars with a fully open gap therebetween for supporting tires with a portion of the tires hanging below the crossbars and a portion of the tires extending laterally beyond the crossbars, the plurality of tire storage racks including movable storage racks and fixed storage racks, a guide arrangement for guiding movement of the movable storage racks, each of said movable storage racks including lower wheels for rolling in contact with a floor, said lower wheels being vertically oriented, and at least one spacing element extending laterally from the racks a distance to separate the racks and to prevent tires on one rack from contacting tires on an adjacent rack by controlling an amount of space between adjacent ones of said plurality of storage racks when a spacing element of one of the plurality of storage racks contacts a spacing element of an adjacent one of the plurality of storage racks so that when adjacent spacing elements are in contact, the spacing elements provide a separation between the racks to avoid contact of tires on adjacent racks, said guide arrangement extending between the fixed storage racks, said guide arrangement including a guide rod, said guide rod cooperating with a guide sleeve mounted on an upper end of the movable storage racks, said guide sleeve encircling said guide rods, the guide sleeve being mounted on a plate, the plate forming the spacing element.

2. The tire rolling storage rack system as claimed in claim 1, wherein said spacing element includes at least one arm located spaced from the storage rack on which the spacing element is mounted.

3. The tire rolling storage rack system as claimed in claim 1, wherein said lower wheels are encased in a protective boot.

4. The tire rolling storage rack system as claimed in claim 1, wherein a plurality of tires are located on said plurality of storage racks.

5. The tire rolling storage rack system as claimed in claim 1, wherein the guide arrangement is anchored to said fixed storage racks.

6. A tire rolling storage rack system comprising a plurality of tire storage racks having spaced horizontally extending crossbars with a frilly open gap therebetween for supporting tires with a portion of the tires hanging below the crossbars and a portion of the tires extending laterally beyond the crossbars, the plurality of tire storage racks including movable storage racks, said movable storage racks being movable between fixed elements located at opposite sides of a group of the movable storage racks, the movable storage racks including lower wheels for rolling in contact with the floor, a guide arrangement for guiding movement of the movable storage racks, and at least one spacing element extending laterally from the racks a distance to separate the racks and to prevent tires on one rack from contacting tires on an adjacent rack by controlling an amount of space between adjacent ones of the movable storage racks so that when adjacent spacing elements are in contact, the spacing elements provide a separation between the racks to avoid contact of the tires on adjacent racks, said guide arrangement extending between the fixed elements, said guide arrangement including a guide rod, said guide rod cooperating with a guide sleeve mounted on an upper end of the movable storage racks, said guide sleeve encircling said guide rod, the guide sleeve being mounted on a plate, the plate forming the spacing element.

7. A tire rolling storage rack system as claimed in claim 6, wherein the fixed elements are fixed storage racks.

8. A tire rolling storage rack system as claimed in claim 6, wherein a plurality of tires are located on said plurality of storage racks.

9. The tire rolling storage rack system as claimed in claim 6, wherein the guide sleeve is a hollow tube.

10. The tire rolling storage rack system as claimed in claim 9, wherein the guide rod has a diameter of one to two inches.

11. The tire rolling storage rack system as claimed in claim 6, wherein a separation distance between the guide sleeve and the guide rod is 1/16 to 1/8 inch.

12. The tire rolling storage rack system as claimed in claim 11, wherein a material is located between the guide sleeve and the guide rod to facilitate sliding of the guide rod within the guide sleeve.

* * * * *